US009423187B2

(12) United States Patent
Fan

(10) Patent No.: US 9,423,187 B2
(45) Date of Patent: Aug. 23, 2016

(54) PLATE TYPE HEAT PIPE WITH MESH WICK STRUCTURE HAVING OPENING

(71) Applicant: Foxconn Technology Co., Ltd., New Taipei (TW)

(72) Inventor: Chih-Feng Fan, New Taipei (TW)

(73) Assignee: Foxconn Technology Co., Ltd., New Taipei (TW)

( * ) Notice: Subject to any disclaimer, the term of this patent is extended or adjusted under 35 U.S.C. 154(b) by 328 days.

(21) Appl. No.: 13/710,482

(22) Filed: Dec. 11, 2012

(65) Prior Publication Data

US 2013/0160977 A1 Jun. 27, 2013

(30) Foreign Application Priority Data

Dec. 26, 2011 (TW) ..... 100148725 A

(51) Int. Cl.

| | |
|---|---|
| ***F28D 15/00*** | (2006.01) |
| ***F28D 13/00*** | (2006.01) |
| ***F28D 15/04*** | (2006.01) |
| ***F28D 15/02*** | (2006.01) |

(52) U.S. Cl.
CPC ..... *F28D 15/04* (2013.01); *F28D 15/0233* (2013.01); *F28D 15/046* (2013.01)

(58) Field of Classification Search
CPC F28D 15/046; F28D 15/04; F28D 2015/0225
USPC ..... 165/104.19, 104.21, 104.26, 104.33
See application file for complete search history.

(56) References Cited

U.S. PATENT DOCUMENTS

| | | | | |
|---|---|---|---|---|
| 3,786,861 | A * | 1/1974 | Eggers | 165/104.26 |
| 2001/0004934 | A1 | 6/2001 | Yomamoto et al. | |
| 2001/0047859 | A1* | 12/2001 | Ishida | B21C 37/151 165/104.14 |
| 2004/0069460 | A1* | 4/2004 | Sasaki et al. | 165/104.26 |
| 2006/0169439 | A1* | 8/2006 | Hong | F28D 15/046 165/104.26 |
| 2007/0107877 | A1* | 5/2007 | Hou et al. | 165/104.26 |
| 2009/0139696 | A1* | 6/2009 | Shih | F28D 15/046 165/104.26 |
| 2010/0157534 | A1 | 6/2010 | Oniki et al. | |
| 2011/0088877 | A1 | 4/2011 | Oniki et al. | |
| 2011/0174465 | A1* | 7/2011 | Liu et al. | 165/104.26 |

FOREIGN PATENT DOCUMENTS

| | | | |
|---|---|---|---|
| CN | 102042779 | A | 5/2011 |
| TW | M367324 | U1 | 10/2009 |
| TW | 201028635 | A1 | 8/2010 |
| TW | 201142232 | A1 | 12/2011 |

* cited by examiner

*Primary Examiner* — Allen Flanigan
*Assistant Examiner* — Claire Rojohn, III
(74) *Attorney, Agent, or Firm* — ScienBiziP, P.C.

(57) ABSTRACT

A plate type heat pipe includes a sealed tube, a chamber defined in the tube, and working medium received in the chamber. A mesh wick structure is attached to an inner wall of the tube. In one version of the plate type heat pipe, the wick structure defines a single opening. The opening communicates the chamber and thereby provides additional space for flow of vaporized working medium inside the tube. In other versions of the plate type heat pipe, the wick structure defines two or more openings.

18 Claims, 11 Drawing Sheets

PLATE TYPE HEAT PIPE WITH MESH WICK STRUCTURE HAVING OPENING

BACKGROUND

1. Technical Field

The disclosure generally relates to heat transfer apparatuses typically used in electronic devices, and particularly to a plate type heat pipe with high heat transfer performance.

2. Description of Related Art

Heat pipes have excellent heat transfer performance and are therefore effective means for transfer or dissipation of heat from heat sources. Currently, heat pipes are widely used for removing heat from heat-generating components such as central processing units (CPUs) of computers. A heat pipe is usually a vacuum casing containing therein a working medium, which is employed to carry, under phase transitions between liquid state and vapor state, thermal energy from one section of the heat pipe (typically referring to as the "evaporator section") to another section thereof (typically referring to as the "condenser section"). Preferably, a wick structure is provided inside the heat pipe, lining an inner wall of the casing, for drawing the working medium back to the evaporator section after it is condensed at the condenser section. A screen mesh inserted into the casing and held against the inner wall thereof is usually used as the wick structure of the heat pipe.

In operation, the evaporator section of the heat pipe is maintained in thermal contact with a heat-generating component. The working medium contained in the evaporator section absorbs heat generated by the heat-generating component and then turns into vapor. Due to the difference in vapor pressure between the two sections of the heat pipe, the generated vapor moves and thus carries the heat towards the condenser section where the vapor is condensed into condensate after releasing the heat into the ambient environment via, for example, fins thermally contacting the condenser section. Due to the difference in capillary pressure which develops in the wick structure between the two sections, the condensate is then brought back by the wick structure to the evaporator section where it is again available for evaporation.

Typically, the screen mesh is attached to the whole inner wall of the casing from the evaporator section to the condenser section. As a result, a space in the heat pipe for the vaporized working medium to flow through may be inadequate. This leads to a high flow resistance for the working medium, and thereby retards the heat transfer capability of the heat pipe.

Therefore, it is desirable to provide a heat pipe with improved heat transfer capability.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views, and all the views are schematic.

DETAILED DESCRIPTION

Figure 1:
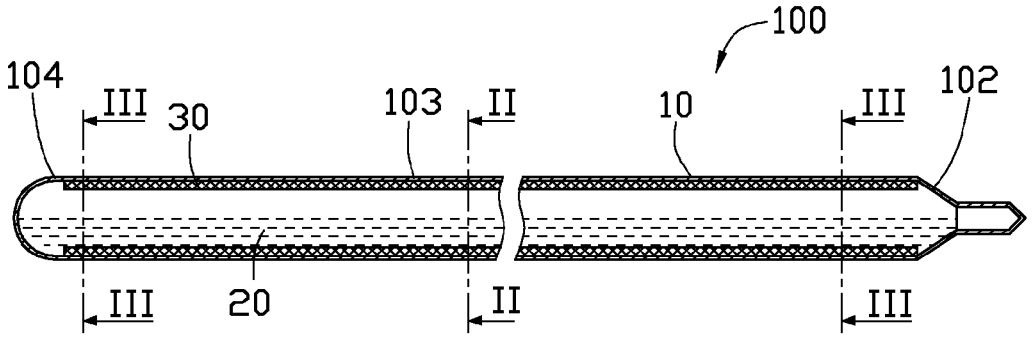
FIG. 1 is an abbreviated, longitudinal cross-sectional view of a plate type heat pipe in accordance with a first embodiment of the present disclosure.

Referring to FIG. 1, a plate type heat pipe 100 in accordance with a first embodiment of the disclosure is shown. The heat pipe 100 includes an elongated flat tube 10, which contains a wick structure 30 and a working medium 20 therein.

Figure 2:
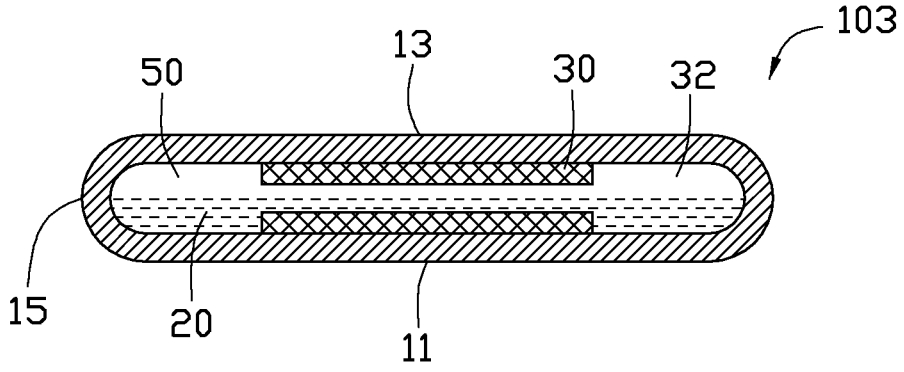
FIG. 2 is a transverse cross-sectional view of an adiabatic section of the heat pipe of the first embodiment, corresponding to line II-II of FIG. 1.
Figure 3:
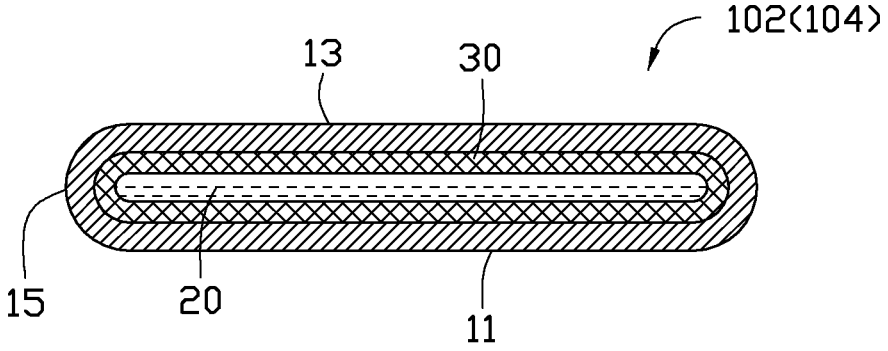
FIG. 3 is a transverse cross-sectional view of both an evaporator section and a condenser section of the heat pipe of the first embodiment, corresponding to lines III-III of FIG. 1.

Also referring to FIGS. 2-3, the tube 10 is made of a highly thermally conductive material such as copper or aluminum. The tube 10 includes an evaporator section 102, a condenser section 104 opposite to the evaporator section 102, and an adiabatic section 103 disposed between the evaporator section 102 and the condenser section 104. A thickness of the tube 10 from top to bottom is less than 2 mm (millimeters). That is, a total height of the tube 10 is less than 2 mm. The tube 10 includes a flat bottom wall 11, a top wall 13 opposite to the bottom wall 11, and two side walls 15 connected between the bottom wall 11 and the top wall 13. The bottom wall 11, the top wall 13 and the side walls 15 cooperatively define a sealed chamber 50. The chamber 50 is in vacuum except for the working medium 20.

The working medium 20 is saturated in the wick structure 30 and is usually selected from a liquid such as water, methanol, or alcohol, which has a low boiling point and is compatible with the wick structure 30. Thus, the working medium 20 can easily evaporate to vapor when it absorbs heat at the evaporator section 102 of the heat pipe 100.

The wick structure 30 is attached to an inner wall of the tube 10. The wick structure 30 extends along an axial direction of the tube 10 from the evaporator section 102 to the condenser section 104. The wick structure 30 is a porous screen mesh structure, and provides a capillary force to drive condensed working medium 20 at the condenser section 104 to flow towards the evaporator section 102 of the heat pipe 100.

Figure 4:
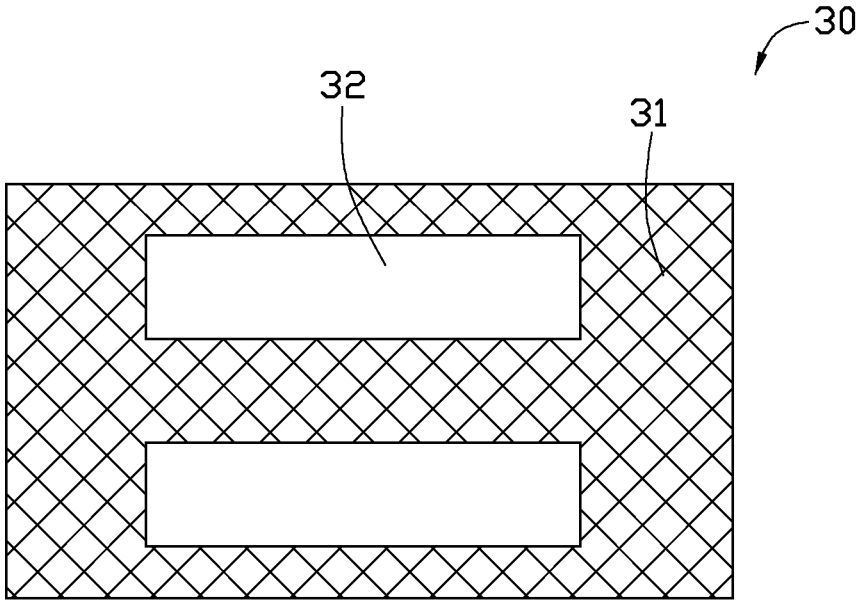
FIG. 4 is a plan view of an unfolded mesh of the heat pipe of FIG. 1, showing the mesh spread out flat from a folded (or rolled) state.

Referring also to FIG. 4, the wick structure 30 is formed by rolling a rectangular mesh 31. The mesh 31 defines two rectangular openings 32 spaced from each other. Each opening 32 is also spaced from an adjacent outer long edge of the mesh 31. The openings 32 are only located at the adiabatic section 103 of the heat pipe 100. In the illustrated embodiment, the openings 32 are identical, and are parallel to each other. A transverse width of each opening 32 (measured from top to bottom in FIG. 4) is approximately one fourth of a corresponding width of the mesh 31. A length of each opening 32 (measured from left to right in FIG. 4) is approximately equal to a length of the adiabatic section 103.

Referring to FIG. 2, a transverse cross-sectional view of the adiabatic section 103 of the heat pipe 100 is shown. The two openings 32 respectively correspond to the side walls 15 at the adiabatic section 103.

Referring to FIG. 3, a transverse cross-sectional view of the evaporator section 102 and the condenser section 104 of the heat pipe 100 is shown. No openings are defined in portions of the wick structure 30 which are respectively attached to the inner walls of the evaporator section 102 and the condenser section 104.

Figure 5:
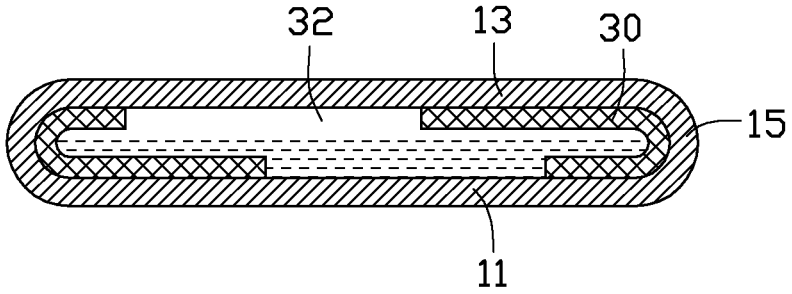
FIG. 5 is a transverse cross-sectional view of an adiabatic section of a plate type heat pipe in accordance with a second embodiment of the present disclosure.

FIG. 5 is a transverse cross-sectional view of the adiabatic section 103 of the plate type heat pipe 100 in accordance with a second embodiment of the present disclosure. The difference between the first embodiment and the second embodiment is that in the second embodiment, the two openings 32 respectively corresponding to the top wall 13 and the bottom wall 11 of the tube 10 after the wick structure 30 is attached to the inner wall of the tube 10. In the illustrated embodiment, the opening 32 at the top wall 13 overlaps the opening 32 at the bottom wall 11.

Figure 6:
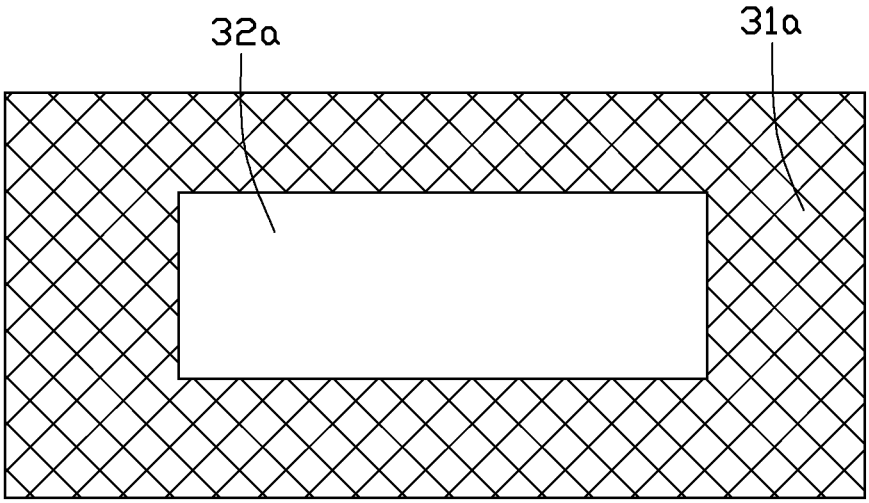
FIG. 6 is a plan view of an unfolded mesh of a plate type heat pipe in accordance with a third embodiment of the present disclosure.

FIG. 6 shows an unfolded mesh 31*a* for the plate type heat pipe 100 in accordance with a third embodiment of the present disclosure. The differences between the meshes 31, 31*a* of the first and third embodiments are as follows. In the third embodiment, only one opening 32*a* is defined in the mesh 31*a*. The opening 32*a* corresponds to the adiabatic section 103 of the plate type heat pipe 100. A transverse width of the opening 32*a* is substantially half of a corresponding width of the mesh 31*a*.

Figure 7:
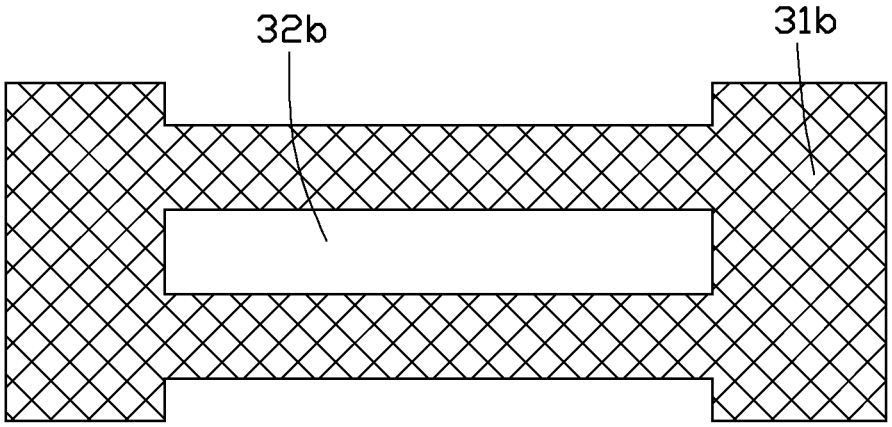
FIG. 7 is a plan view of an unfolded mesh of a plate type heat pipe in accordance with a fourth embodiment of the present disclosure.

FIG. 7 shows an unfolded mesh 31*b* for the plate type heat pipe 100 in accordance with a fourth embodiment of the present disclosure. The differences between the meshes 31, 31*b* of the first and fourth embodiments are as follows. In the fourth embodiment, the mesh 31*b* defines three spaced, parallel, rectangular openings 32*b* corresponding to the adiabatic section 103 of the heat pipe 100. One of the three openings 32*b* is defined in a middle of the mesh 31*b*. The other two openings 32*b* are respectively defined in two opposite long sides of the mesh 31*b*. Outer extremities of the other two openings 32*b* are aligned with opposite outer long edges of the mesh 31*b*, respectively. That is, the other two openings 32*b* communicate with lateral exteriors of the mesh 31*b*. A total transverse width of the three openings 32*b* is substantially half of a corresponding width of the mesh 31*b*.

Figure 8:
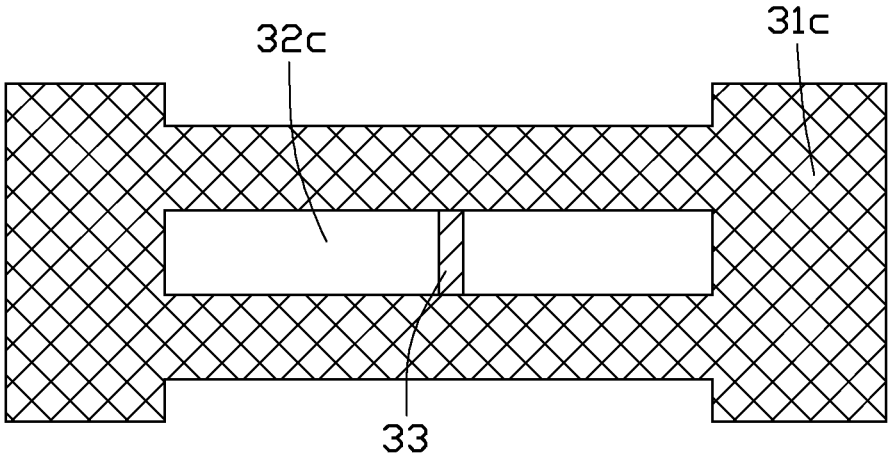
FIG. 8 is essentially a plan view of an unfolded mesh of a plate type heat pipe in accordance with a fifth embodiment of the present disclosure.

FIG. 8 shows an unfolded mesh 31*c* for the plate type heat pipe 100 in accordance with a fifth embodiment of the present disclosure. The mesh 31*c* defines three spaced, parallel, rectangular openings 32*c* corresponding to the adiabatic section 103 of the heat pipe 100. One of the three openings 32*c* is defined in a middle of the mesh 31*c*, and the other two openings 32*c* are respectively defined in two opposite long sides of the mesh 31*c*. Outer extremities of the other two openings 32*c* are aligned with opposite outer long edges of the mesh 31*c*, respectively. That is, the other two openings 32*c* communicate with lateral exteriors of the mesh 31*c*. A total transverse width of the three openings 32*c* is substantially half of a corresponding width of the mesh 31*c*. The difference between the meshes 31*b*, 31*c* of the fourth and fifth embodiments is, in the fifth embodiment, a copper sheet 33 is connected between two opposite long side edges of the middle opening 32*c*, to reinforce the strength of the mesh 31*c*.

Figure 9:
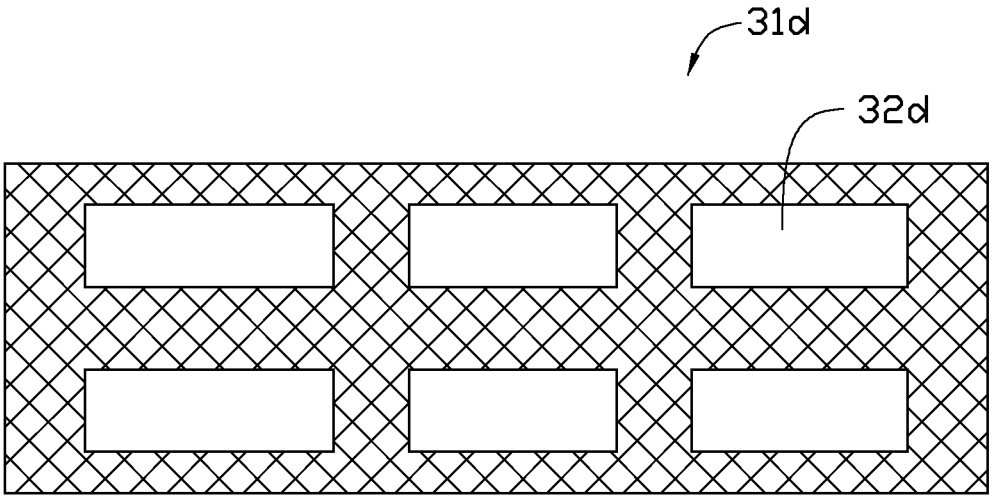
FIG. 9 is a plan view of an unfolded mesh of a plate type heat pipe in accordance with a sixth embodiment of the present disclosure.

FIG. 9 shows an unfolded mesh 31*d* for the plate type heat pipe 100 in accordance with a sixth embodiment of the present disclosure. The differences between the meshes 31, 31*d* of the first and sixth embodiments are as follows. In the sixth embodiment, the mesh 31*d* defines six spaced rectangular openings 32*d* extending in two rows along the axial direction of the tube 10 from the evaporator section 102 to the condenser section 104. The two rows of openings 32*d* are parallel to each other. All the openings 32*d* have a same transverse width. The two openings 32*d* in a middle of the mesh 32*d* have the same length, are directly opposite each other, and correspond to the adiabatic section 103 of the heat pipe 100. The two openings 32*d* in one of opposite ends of the mesh 31*d* have the same length, are directly opposite each other, and are adjacent to the condenser section 104 of the heat pipe 100. The two openings 32*d* in the other opposite end of the mesh 31*d* have the same length, are directly opposite each other, and are adjacent to the evaporator section 102 of the heat pipe 100.

Figure 10:
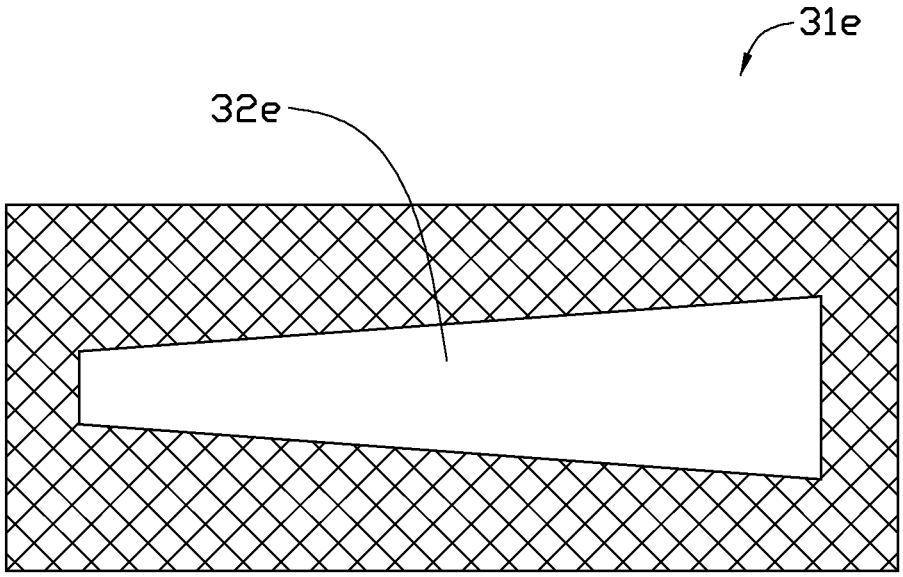
FIG. 10 is a plan view of an unfolded mesh of a plate type heat pipe in accordance with a seventh embodiment of the present disclosure.

FIG. 10 shows an unfolded mesh 31*e* for the plate type heat pipe 100 in accordance with a seventh embodiment of the present disclosure. The mesh 31*e* defines an isosceles trapezoidal opening 32*e*. The parallel sides of the opening 32*e* are substantially perpendicular to opposite long sides of the mesh 31*e*. The opening 32*e* extends along the axial direction of the tube 10 from the evaporator section 102 to the condenser section 104. In one embodiment, the long parallel side of the opening 32*e* is adjacent to the evaporator section 102, and the short parallel side of the opening 32*e* is adjacent to the condenser section 104.

Figure 11:
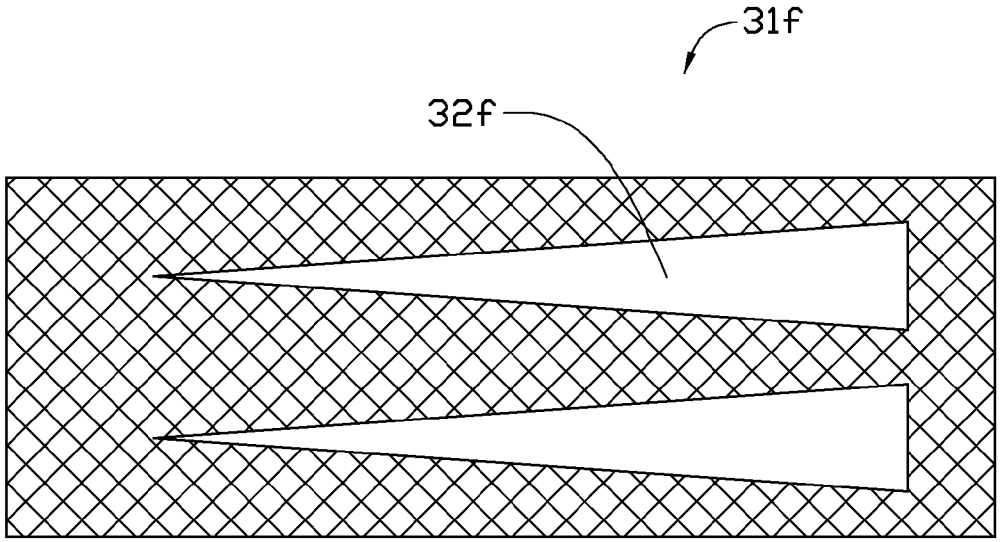
FIG. 11 is a plan view of an unfolded mesh of a plate type heat pipe in accordance with an eighth embodiment of the present disclosure.

FIG. 11 shows an unfolded mesh 31*f* for the plate type heat pipe 100 in accordance with an eighth embodiment of the present disclosure. The mesh 31*f* defines two elongated, isosceles triangular openings 32*f*. In the illustrated embodiment, the openings 32*f* are identical, and are arranged side by side. Bases of the openings 32*f* (i.e. the two non-equal sides of the openings 320 are aligned with each other, and are substantially perpendicular to opposite long sides of the mesh 31*f*. Vertexes of the openings 32*f* point in the same direction. The openings 32*f* extend along the axial direction of the tube 10 from the evaporator section 102 to the condenser section 104. In one embodiment, the bases of the openings 32*f* are adjacent to the evaporator section 102, and the vertexes of the openings 32*f* are adjacent to the condenser section 104.

According to the disclosure, a total area of the wick structure 30 is reduced due to the openings being defined in the wick structure 30, thereby increasing a space in the heat pipe 100 for the vaporized working medium 20 to flow therethrough. Therefore, compared with conventional heat pipes, the heat pipe 100 has not only a low flow resistance, but also a large capillary force. These advantages facilitate improving the heat transfer capability of the heat pipe 100.

Table 1 below shows an average of maximum heat transfer rates (Qmax) and an average of heat resistances (Rth) of a conventional mesh type heat pipe and certain of the heat pipes 100 in accordance with the present disclosure. The conventional mesh type heat pipe and the heat pipes 100 in Table 1 all have a thickness of 1 mm. Qmax represents the maximum heat transfer rate of each heat pipe at an operational temperature of 50° C. Rth is obtained by dividing the difference between an average temperature of the evaporator section of the heat pipe and an average temperature of the condenser section of the heat pipe by Qmax.

The average of Rth of the heat pipes 100 with the mesh 31*a* defining one opening 32*a* is substantially equal to that of the conventional mesh type heat pipe, and the average of Qmax of the heat pipe 100 with the mesh 31*a* defining one opening 32*a* is significantly more than that of the conventional mesh type heat pipe. The average of Rth of the heat pipe 100 with the mesh 31 defining two openings 32 (i.e., the heat pipe of the first embodiment) is significantly less than that of the conventional mesh type heat pipe, and the average of Qmax of the heat pipe 100 with the mesh 31 defining two openings 32 is slightly more than that of the conventional mesh type heat pipe. The average of Rth of the heat pipe 100 with the mesh 31*c* defining three openings 32*c* and the copper sheet 33 is significantly more than that of the conventional mesh type heat pipe, and the average of Qmax of the heat pipe 100 with the mesh 31*c* defining three openings 32*c* and the copper sheet 33 is significantly more than that of the conventional mesh type heat pipe.

TABLE 1

| Type of heat pipe | Average of Qmax (unit: W) | Average of Rth (unit: ° C./W) |
|---|---|---|
| Conventional mesh type heat pipe | 8.1 | 0.6 |
| Heat pipe 100 with the mesh 31a defining one opening 32a | 12.5 | 0.61 |
| Heat pipe 100 with the mesh 31 defining two openings 32 | 8.3 | 0.33 |
| Heat pipe 100 with the mesh 31c defining three openings 32c and the copper sheet 33 | 11.9 | 1.07 |

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A plate type heat pipe comprising:

a sealed tube defining a chamber therein, the tube having an evaporator section, a condenser section opposite to the evaporator section, and an adiabatic section disposed between the evaporator section and the condenser section, the tube comprising a flat bottom wall, a flat top wall opposite to the bottom wall, and two side walls connected between the bottom wall and the top wall;

a working medium received in the chamber; and a mesh wick structure attached to an inner wall of the tube in the chamber, the wick structure defining at least one opening, the at least one opening providing additional space for flow of vaporized working medium inside the tube, the wick structure being a rolled mesh, the at least one opening being two parallel, elongated openings, the the two openings are defined entirely in the rolled mesh and being respectively located directly adjacent to the side walls of the tube at the adiabatic section, each opening extends from the top wall to the bottom wall along one of the side walls of the tube at the adiabatic section, and the inner wall of the flat bottom wall, the flat top wall and the side walls of the tube being entirely covered by the wick structure except the openings.

2. The plate type heat pipe of claim 1, wherein each of the at least one opening is one of triangular, rectangular and isosceles trapezoidal.

3. The plate type heat pipe of claim 1, wherein the at least one opening is located directly adjacent to the adiabatic section of the tube only.

4. The plate type heat pipe of claim 1, wherein a length of the at least one opening is equal to a length of the adiabatic section.

5. The plate type heat pipe of claim 1, wherein each of the two openings is spaced from an outer long edge of the mesh when the mesh is unrolled and flat.

6. The plate type heat pipe of claim 1, wherein no openings are defined in portions of the wick structure which are respectively attached to the inner wall of the tube at the evaporator section and the condenser section.

7. The plate type heat pipe of claim 5, wherein the tube comprises a flat bottom wall, a flat top wall opposite to the bottom wall, and two side walls connected between the bottom wall and the top wall, the two openings respectively corresponding to the top wall and the bottom wall of the tube at the adiabatic section.

8. The plate type heat pipe of claim 1, wherein the at least one opening is a single opening, a width of the opening being substantially half of a width of the mesh when the mesh is unrolled and flat.

9. The plate type heat pipe of claim 5, wherein a width of each of the openings is approximately one fourth of a width of the mesh when the mesh is unrolled and flat.

10. The plate type heat pipe of claim 1, wherein the at least one opening is defined in a middle of the mesh.

11. The plate type heat pipe of claim 1, wherein the tube comprises an evaporator section, a condenser section opposite to the evaporator section, and an adiabatic section disposed between the evaporator section and the condenser section, the at least one opening extending along an axial direction of the tube between the evaporator section and the condenser section.

12. The plate type heat pipe of claim 1, wherein a thickness of the tube from top to bottom is less than 2 mm (millimeters).

13. The plate type heat pipe of claim 1, wherein the at least one opening is three parallel, elongated openings, one of the three openings being defined in a middle of the mesh and the other two of the three openings being respectively defined in two opposite long sides of the mesh when the mesh is unrolled and flat.

14. The plate type heat pipe of claim 13, wherein a copper sheet is connected between two opposite sides of the middle opening to reinforce the strength of the mesh.

15. A plate type heat pipe comprising:

a sealed tube defining a chamber therein, the tube comprising an evaporator section, a condenser section opposite to the evaporator section, and an adiabatic section disposed between the evaporator section and the condenser section, the tube comprising a flat bottom wall, a flat top wall opposite to the bottom wall, and two side walls connected between the bottom wall and the top wall;

a working medium received in the chamber; and a mesh wick structure attached to an inner wall of the tube in the chamber and extending along an axial direction of the tube from the evaporator section to the condenser section, the wick structure defining at least one opening at the adiabatic section only, the wick structure being a rolled mesh, the at least one opening being two parallel, elongated openings, the two openings are defined entirely in the rolled mesh and being respectively located directly adjacent to the side walls of the tube at the adiabatic section, each opening extends from the top wall to the bottom wall along one of the side walls of the tube at the adiabatic section, and the inner wall of the flat bottom wall, the flat top wall and the side walls of the tube being entirely covered by the wick structure except the openings.

16. The plate type heat pipe of claim 15, wherein the at least one opening is six spaced rectangular openings extending in two rows along the axial direction of the tube from the evaporator section to the condenser section, the two openings in a middle of the wick structure corresponding to the adiabatic section, the two openings in one of opposite ends of the wick structure being adjacent to the condenser section, and the two openings in the other opposite end of the wick structure being adjacent to the evaporator section.

17. The plate type heat pipe of claim 15, wherein the at least one opening is an isosceles trapezoidal opening, the opening extending along the axial direction of the tube from the evaporator section to the condenser section, the parallel sides of the opening being substantially perpendicular to the axial direction of the tube, the long parallel side of the opening being adjacent to the evaporator section, and the short parallel side of the opening being adjacent to the condenser section.

18. The plate type heat pipe of claim 15, wherein the at least one opening is two elongated, isosceles triangular openings, the openings being identical and arranged side by side, bases of the openings being aligned with each other, vertexes of the openings pointing in the same direction, and the openings extending along the axial direction of the tube from the evaporator section to the condenser section.

* * * * *